US006668613B2

(12) United States Patent
Lefavour et al.

(10) Patent No.: US 6,668,613 B2
(45) Date of Patent: Dec. 30, 2003

(54) HYDRAULIC COMPRESSION TOOL AND HYDRAULIC COMPRESSION TOOL MOTOR

(75) Inventors: John D. Lefavour, Litchfield, NH (US); Christopher G. Chadbourne, Nashua, NH (US); Armand T. Montminy, Manchester, NH (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/119,456

(22) Filed: Apr. 9, 2002

(65) Prior Publication Data

US 2003/0188566 A1 Oct. 9, 2003

(51) Int. Cl.[7] ..... B21D 9/18; H01R 43/042; B26B 17/00

(52) U.S. Cl. ..... 72/453.03; 72/453.15; 72/453.16; 30/180; 29/751

(58) Field of Search ..... 72/453.02, 453.03, 72/453.15, 453.16, 416, 455, 456; 30/180, 182, 241; 29/751

(56) References Cited

U.S. PATENT DOCUMENTS

| | | | | | |
|---|---|---|---|---|---|
| 3,733,699 | A | * | 5/1973 | Bock | 30/180 |
| 4,226,110 | A | | 10/1980 | Suganuma | 72/416 |
| 4,292,833 | A | | 10/1981 | Lapp | 72/416 |
| 4,366,673 | A | | 1/1983 | Lapp | 60/477 |
| 4,382,331 | A | * | 5/1983 | Kimura | 30/241 |
| 4,750,347 | A | * | 6/1988 | Saarinen | 72/453.16 |
| 4,796,461 | A | | 1/1989 | Mead | 72/453.16 |
| 5,111,681 | A | | 5/1992 | Yasui et al. | 72/453.03 |
| 5,134,989 | A | | 8/1992 | Akahane | 125/40 |
| 5,195,354 | A | | 3/1993 | Yasui et al. | 72/453.03 |
| 5,282,378 | A | * | 2/1994 | Kimura | 72/453.15 |

(List continued on next page.)

OTHER PUBLICATIONS

Patent Abstract of Japan—Publication No. 11–179681; Attachment for Multifunctional Tool.
Patent Abstract of Japan—Publication No. 11–198057; Power Tool.
Patent Abstract of Japan—Publication No. 11–198058; Power Tool.
Patent Abstract of Japan—Publication No. 11–198062; Power Tool.
Patent Abstract of Japan—Publication No. 11–251030; Hydraulic Crimping Tool.
Patent Abstract of Japan—Publication No. 06–198574; Cordless Electric Small–Sized Crimp Tool.
Patent Abstract of Japan—Publication No. 06–262427; Oil Pressure Releasing Mechanism for Power Hydraulic Tool.
Patent Abstract of Japan—Publication No. 08–011066; Hudraulic Crimp Tool.
Patent Abstract of Japan—Publication No. 08–321371; Hydraulic Crimping Device.
Patent Abstract of Japan—Publication N. 09–177707; Hydraulic Circuit for Hydraulic Pump for Double Acting Hydraulic Cylinder.

*Primary Examiner*—David B. Jones
(74) *Attorney, Agent, or Firm*—Harrington & Smith, LLP

(57) ABSTRACT

A transmission for connecting a rotary motor output shaft to a rectilinear actuator which is moveable rectilinearly along an actuator axis of translation. The transmission comprises a frame, an eccentric, and a rectilinear guide. The frame has a bore formed therein. The eccentric is adapted to position the frame on the rotary motor output shaft. The eccentric is rotatably mounted in the bore of the frame to rotate relative to the frame. The rectilinear guide is connected to the frame. The rectilinear guide has a slide surface adapted to be slidably seated against the rectilinear actuator allowing the frame to slide substantially rectilinearly relative to the rectilinear actuator. While this drive is especially suited for use on a hydraulic crimping tool, the drive is also suited for use with any kind of hydraulic power tool.

27 Claims, 6 Drawing Sheets

U.S. PATENT DOCUMENTS

| | | | | | |
|---|---|---|---|---|---|
| 5,442,992 | A | | 8/1995 | Sanner et al. | 91/428 |
| D374,805 | S | | 10/1996 | Moffatt et al. | D8/107 |
| 5,598,737 | A | * | 2/1997 | Oide | 72/453.01 |
| 5,727,417 | A | | 3/1998 | Moffatt et al. | 72/453.03 |
| 5,778,755 | A | | 7/1998 | Boese | 91/399 |
| 5,802,901 | A | | 9/1998 | Oda et al. | 72/161 |
| D408,242 | S | | 4/1999 | Yamamoto | D8/61 |
| 5,924,536 | A | | 7/1999 | Frenken | 192/56.1 |
| 5,934,136 | A | | 8/1999 | Bracher et al. | 72/397 |
| 6,044,681 | A | | 4/2000 | Frenken | 72/292 |
| 6,065,326 | A | | 5/2000 | Frenken | 72/453.15 |
| 6,085,422 | A | | 7/2000 | Hirabayashi | 30/122 |
| 6,206,663 | B1 | | 3/2001 | Frenken | 417/549 |
| 6,230,542 | B1 | | 5/2001 | Frenken | 72/456 |
| 6,401,515 | B2 | * | 6/2002 | Frenken | 72/453.15 |
| 6,415,641 | B1 | * | 7/2002 | Wagner | 72/453.16 |

* cited by examiner

HYDRAULIC COMPRESSION TOOL AND HYDRAULIC COMPRESSION TOOL MOTOR

BACKGROUND OF THE INVENTION

1. Field of the Invention

The present invention generally relates to hydraulic compression tools and, more particularly, to drives for hydraulic compression tools having rotary motors.

2. Brief Description of Earlier Developments

Hydraulic power tools are used in numerous applications to provide users with a desired mechanical advantage. One such application is in crimping tools used for making crimping connections, such as for example, crimping power connectors onto conductors, or grounding connectors onto grounding wires. Other applications include jacking devices, presses and so on. In these cases, many operators desire that the hydraulic tools be powered, or in other words that the hydraulics be actuated by a motor merely at the flip of a switch or the press of a button. Naturally, a powered hydraulic tool does away with manual pumping by the operator to actuate the hydraulics, and hence, involves much less physical effort on the part of the operator to operate the tool. In addition to the significantly smaller physical effort, another desired advantage of the powered hydraulic tool compared to manual hydraulic tools, is that the powered tool may be faster. This allows tasks to be accomplished with the tool to be completed faster with a resulting reduction in cost. Indeed, for portable hydraulic tools, such as for example, hydraulic crimping tools, which are held and supported in the hands of the operator, the operating speed (e.g. how quickly the hydraulic ram is traversed through its stroke) of the tool becomes even more important. The quicker the task can be completed, the sooner the operator can put the tool down. Powered hydraulic tools are more complex, and hence more expensive as a rule, than their manually actuated counterparts. The added complexity may also tend to make powered hydraulic tools more susceptible to breakdown. This may be frustrating to the operator, as well as costly especially for tools used in the field where repair may not be readily available. Conventional powered hydraulic tools which employ a piston pump to operate the hydraulics generally may have a spring loaded piston to provide impetus to the piston in at least one direction and/or a camming mechanism capable of reciprocating the piston during operation.

U.S. Pat. No. 6,206,663 discloses one example of a piston pump for a hydraulic tool wherein the pump has a low-pressure delivery piston which is spring loaded to drive the piston to achieve fluid delivery at low pressure. The low pressure piston is moved back counter to the spring load prestress by a high pressure piston moved by a rotating shaft.

Another example is disclosed in U.S. Pat. No. 5,727,417 in which the hydraulic drive tool has a drive assembly with a wobble plate providing axial displacement to a spring loaded piston. The spring preload on the pistons returns the pistons to a fluid delivery starting position. Still other examples are disclosed in U.S. Pat. Nos. 5,111,681 and 5,195,354 in which a motor driven hydraulic tool has a motor operatively connected to a hydraulic pump via a cam link mechanism. The cam link mechanism has a plunger with a ring shaped fitting portion which has an eccentric shaft fitted therein to rotate freely.

The present invention overcomes the problems of conventional hydraulic tools as will be described in greater detail below. In accordance with one aspect of a preferred embodiment, the piston pump is springless, reciprocated by a cam link mechanism to the motor without assistance from spring preload. Moreover, in accordance with another aspect of the preferred embodiment, the cam link mechanism between the motor and piston is simple to manufacture and install, employing large bearing surfaces which reduces the cost of the tool while increasing reliability. These aspects as well as others will be described in greater detail below.

SUMMARY OF THE INVENTION

In accordance with a first embodiment of the present invention, a hydraulic tool drive is provided. The hydraulic tool drive comprises a frame, a hydraulic ram, a pump, a motor, and a link. The frame has a hydraulic reservoir. The hydraulic ram is movably mounted to the frame. The pump has a pump piston for pumping hydraulic fluid to move the hydraulic ram relative to the frame. The motor is connected to the frame. The motor has an output shaft which rotates about an axis of rotation when the motor is operating. The link operably connects the output shaft to the pump piston for generating a reciprocating movement of the pump piston relative to the pump when the motor is operated. The link is rotatably mounted on the output shaft and is pivotable at least at one end relative to the frame, wherein at least one end of the link is pivotally connected to the pump piston by a pin.

In accordance with another embodiment of the present invention, a hydraulic tool drive is provided. The tool drive comprises a frame, a hydraulic ram, a pump, a motor, and a collar. The frame has a hydraulic reservoir. The hydraulic ram is moveably mounted to the frame. The pump is connected to the frame. The pump has a pump piston for pumping hydraulic fluid to move the hydraulic ram relative to the frame. The pump piston is moveable relative to the pump along an axis of translation. The motor is connected to the frame. The motor has a rotary output shaft. The collar is connected to the rotary output shaft and has a joint at which the collar is moveably joined to the pump piston to move relative to the pump piston along another axis of translation which is substantially orthogonal to the axis of translation of the pump piston, wherein the collar comprise a frame with a generally cylindrical bore in which the rotary output shaft is eccentrically located, the frame having a clevis at one end which forms the joint in the collar.

In accordance with another embodiment of the present invention, a hydraulic tool drive is provided. The tool drive comprises a frame, a hydraulic ram, a pump, a motor, and a collar. The frame has a hydraulic reservoir. The hydraulic ram is moveably mounted to the frame. The pump is connected to the frame. The pump has a pump piston for pumping hydraulic fluid to move the hydraulic ram relative to the frame. The pump piston is moveable relative to the pump along an axis of translation. The motor is connected to the frame. The motor has a rotary output shaft. The collar is connected to the rotary output shaft and has a joint at which the collar is moveably joined to the pump piston to move relative to the pump piston along another axis of translation which is substantially orthogonal to the axis of translation of the pump piston, wherein the drive further comprises an eccentric fixedly mounted to the rotary output shaft, the eccentric being engaged to the collar so that when the motor rotates the rotary output shaft the collar is moved in an orbital motion relative to the output shaft.

In accordance with still another embodiment of the present invention, a hydraulic crimping tool is provided. The tool comprises a frame, a hydraulic ram, a pump, a motor, and a transmission. The frame has a hydraulic reservoir. The hydraulic ram is movably mounted to the frame. The pump is connected to the frame. The pump has a pump piston for hydraulically moving the hydraulic ram relative to the frame. The motor is connected to the frame. The motor has a rotary output shaft to the pump piston. The transmission comprises an eccentric. The eccentric is fixable mounted onto the rotary output shaft. The transmission comprises a collar rotatable mounted onto the eccentric to rotate relative to the eccentric. The collar is movably joined to the pump piston, wherein the collar has a clevis, the pump piston being pinned to the collar in the clevis.

In accordance with yet another embodiment of the present invention, a transmission for connecting a rotary motor output shaft to a rectilinear actuator which is movable rectilinearly along an actuator axis of translation is provided. The transmission comprises a frame, an eccentric, and a rectilinear guide. The frame has a bore formed therein. The eccentric is adapted to position the frame on the rotary motor output shaft. The eccentric is rotatably mounted in the bore of the frame to rotate relative to the frame. The rectilinear guide is connected to the frame. The rectilinear guide has a slide surface adapted to slidably seat against the rectilinear actuator allowing the frame to slide substantially rectilinearly relative to the rectilinear actuator, wherein the frame has a recess formed therein, the recess being sized and shaped for movably locating at least part of the rectilinear actuator in the recess, the rectilinear guide extending across the recess.

In accordance with a further embodiment of the present invention, a hydraulic tool drive is provided. The hydraulic tool drive comprises a frame, a hydraulic ram, a pump, a motor, and a link. The frame has a hydraulic reservoir. The hydraulic ram is movably mounted to the frame. The pump has a pump piston for pumping hydraulic fluid to move the hydraulic ram relative to the frame. The motor is connected to the frame. The motor has an output shaft which rotates about an axis of rotation when the motor is operating. The link operably connects the output shaft to the pump piston for generating a reciprocating movement of the pump piston relative to the pump when the motor is operated. The link is rotatably mounted on the output shaft and is pivotable at least at one end relative to the frame, wherein the link has an end which is movably mounted to the pump piston so that the link moves freely relative to the pump piston.

In accordance with another embodiment of the present invention, a hydraulic tool drive is provided. The hydraulic tool drive comprises a frame, a hydraulic ram, a pump, a motor, and a link. The frame has a hydraulic reservoir. The hydraulic ram is movably mounted to the frame. The pump has a pump piston for pumping hydraulic fluid to move the hydraulic ram relative to the frame. The motor is connected to the frame. The motor has an output shaft which rotates about an axis of rotation when the motor is operating. The link operably connects the output shaft to the pump piston for generating a reciprocating movement of the pump piston relative to the pump when the motor is operated. The link is rotatably mounted on the output shaft and is pivotable at least at one end relative to the frame, wherein the link has a recess at one end, at least one end of the pump piston being located in the recess.

In accordance with yet another embodiment of the present invention, a transmission for connecting a rotary motor output shaft to a rectilinear actuator which is movable rectilinearly along an actuator axis of translation is provided. The transmission comprises a frame, an eccentric, and a rectilinear guide. The frame has a bore formed therein. The eccentric is adapted to position the frame on the rotary motor output shaft. The eccentric is rotatably mounted in the bore of the frame to rotate relative to the frame. The rectilinear guide is connected to the frame. The rectilinear guide has a slide surface adapted to slidably seat against the rectilinear actuator allowing the frame to slide substantially rectilinearly relative to the rectilinear actuator, wherein the rectilinear guide comprises a pin, an outer surface of the pin forming the slide surface.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
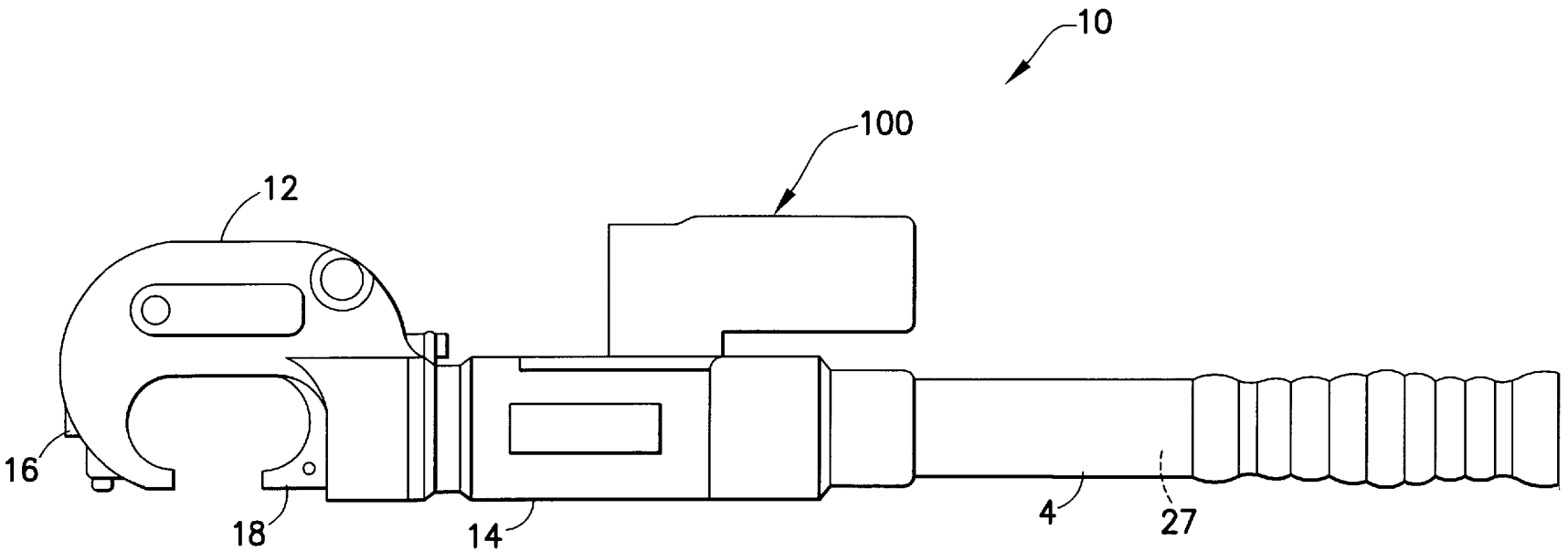
FIGS. 1–1A respectively are a schematic view of a hydraulic compression tool and perspective view of part of the tool incorporating features in accordance with one embodiment of the present invention.

Referring to FIG. 1, there is shown a schematic view of a drive 100 used with hydraulic tool 10 incorporating features of the present invention. Although the present invention will be described with reference to the single exemplary embodiment shown in the drawings, it should be understood that the present invention can be embodied in many alternate forms of embodiments. In addition, any suitable size, shape or type of elements or materials could be used.

Figure 1A:
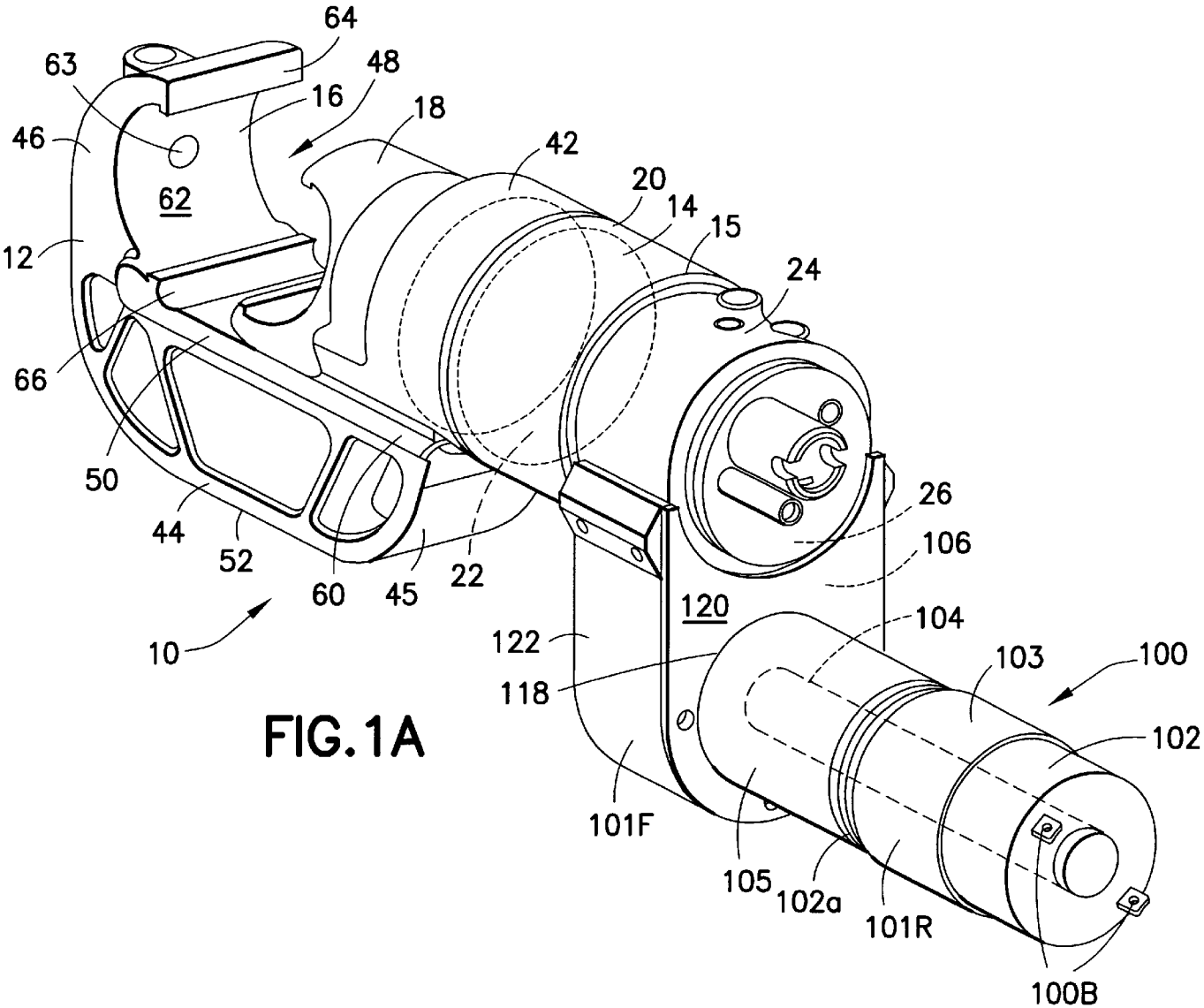
Figure 2:
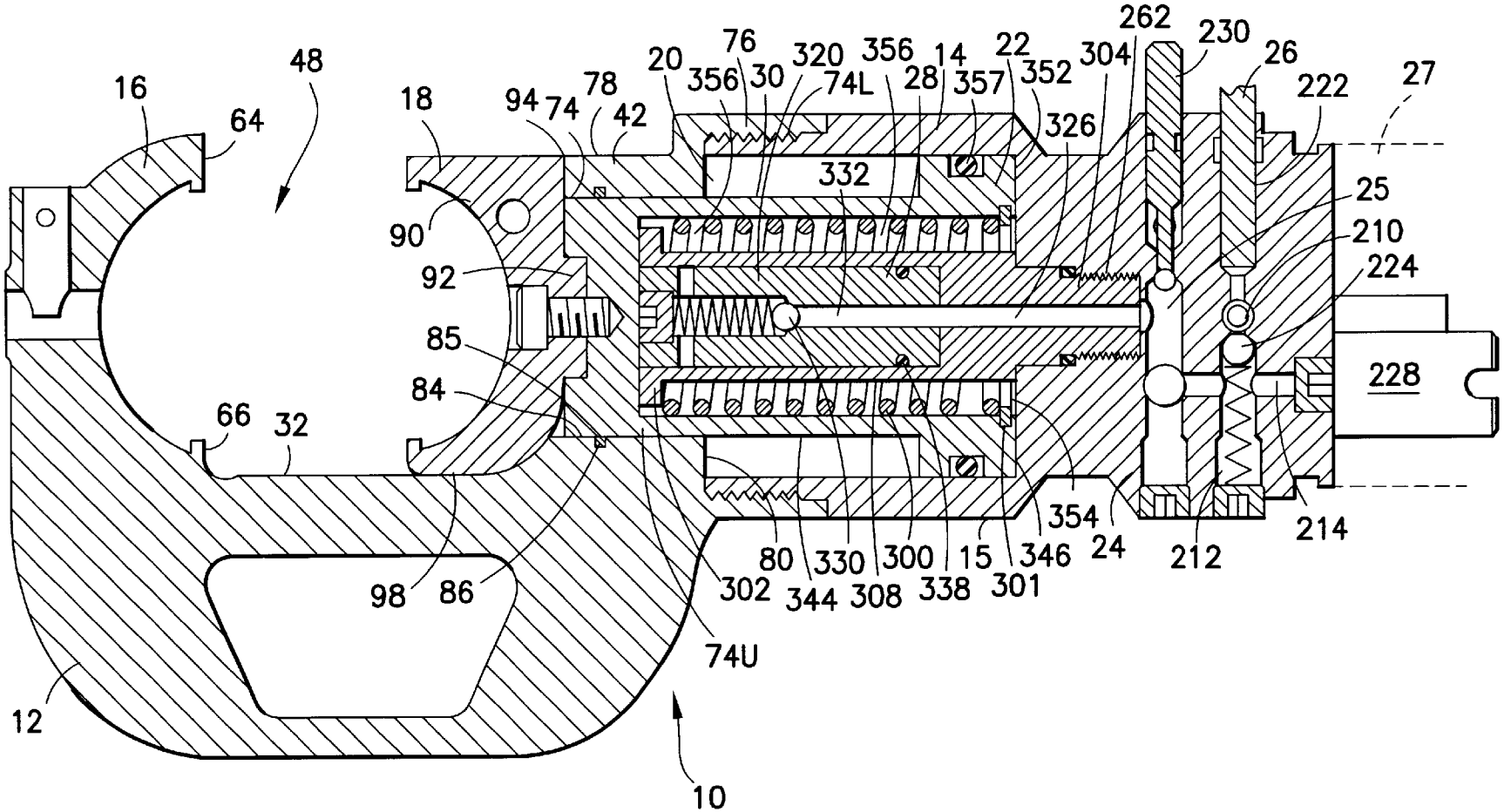
FIG. 2 is a cross-sectional elevation of a head section and pump body of the hydraulic compression tool in FIG. 1.

The present invention is described below with particular reference to a portable hydraulic tool 10 and the drive therefor, though the invention is equally applicable to any suitable type of hydraulic power tool. Referring also to FIGS. 1A–2, which show a partial perspective view and cross-sectional elevation view of the hydraulic crimping tool 10, the tool generally comprises a head section 12, a hydraulic power section 14, a motor section 100, and a handle 4. The head section 12 is connected to the hydraulic power section 14. The motor section 100 is connected to the hydraulic power section 14 generally opposite the head section. The handle section, used by the operator to support and position the tool, may extend from the hydraulic power section, also generally opposite the head section, and may incorporate the motor section at least in part. The head section generally has a static or anvil adapter 16 and movable adapter 18. The anvil adapter 16 is located at one end of the head section. The movable adapter 18 is movably seated in the head section. The hydraulic power section 14 generally has a hydraulic cylinder 20, a ram assembly 22, and a pump body 24. The ram assembly 22 is located in the cylinder 20 and is connected to the movable adapter 18 in the head section. The pump body 24 is connected to the hydraulic cylinder 20. The hydraulic power section 14 has a pump 26 (see also FIG. 2) located in the pump body for pumping hydraulic fluid through the pump body into the hydraulic cylinder. The handle may include a reservoir 27 (see FIG. 2) for hydraulic fluid used in the hydraulic power section. The motor section 100 generally has a suitable electromechanical motor 102 having an EMF shield 103 covering the brush portion thereof and which powers a drive shaft 104 (in phantom). Drive shaft 104 and motor 102 are connected to transmission linkage 106 via gearbox 105 and adaptor plate 102*a*. The drive shaft 104 is connected by transmission linkage 106 to the pump 26. When the pump 26 is operated by the motor 102, hydraulic fluid from reservoir 27 is pumped through the pump body 24 to the hydraulic cylinder 20 and the ram assembly 22 therein. Hydraulic fluid presses against ram assembly 22 thereby advancing the ram 30 or assembly 22, and the movable adapter 18, connected to the ram 30, towards the anvil 16. The transmission linkage 106 connecting the drive shaft 104 in the motor section 100 and the pump 26 converts rotary motion of the drive shaft into rectilinear reciprocating translation of the pump as will be described in greater detail below.

One embodiment of the hydraulic tool will be described in detail below with specific reference to the crimping tool 10 shown in FIG. 1, although as noted before the present invention is equally applicable to any suitable kind of hydraulic power tool. As seen best in FIGS. 1–2, in this embodiment, the head section 12 of the tool 10 generally has a base or collar section 42 for connecting the head section to the rest of the tool, and an upper section 44. The upper section 44 depends from the collar section 42. The head section 12 may be a one piece member made from suitable metal by drop forging or casting, or alternatively the section may be an assembly of independently manufactured parts. The upper section 44 may have a general scallop or general C shape, as shown in FIG. 1A, which defines a workspace 48 in the head section 12. In alternate embodiments, the head section structure may have any other suitable configuration providing a workspace in which work pieces may be placed into the head section. The upper section 44 has a longitudinal portion 45, which forms the back or spine of the C shape, and an upper end 46. The longitudinal portion 45 may be a space frame with inner and outer walls 50, 52 tied to each other by truss supports and curved beam end portions. The truss supports are arranged to form a series of voids in the longitudinal portion 45 which significantly reduces the weight of the head section 12 without loss in structural strength and rigidity. Reinforcing ribs 60 may be formed alongside the inner wall 50, as shown in FIG. 1A, in order to further increase the rigidity of the head section 12.

As can be realized from FIG. 1A, upper end 46 of section 44 is generally curved and forms the anvil adapter 16 at the top of the workspace 48 in the head section. As seen in FIG. 1A, in the preferred embodiment, a bore 63 is formed through the upper end 46 to the seating surface 62 of the anvil adapter 16 for mounting a die (not shown) to the anvil adapter. The curved seating surface 62 may provide a working surface against which work pieces having a round outer surface with a diameter complementing surface 62 may be seated. In the case where the work piece does not have a round outer surface which complements surface 62, a die may be mounted using bore 63 to the anvil adapter allowing the work piece to be stably supported from the anvil adapter. The anvil adapter 16 has outer and inner stop surfaces 64, 66 which stop the travel of the movable adapter 18 in the work space 48 (see FIG. 1A). The inner surface 32 of the inner wall 50 is substantially flat, as seen in FIG. 1A, and provides a guide surface to adapter 18 as will be described below. As seen in FIG. 1A, in this embodiment the collar section 42 has a generally cylindrical shape with a cylindrical bore 74 (See FIG. 2) formed therein. In alternate embodiments, the base section of the head section may have any other suitable shape for mating the head section to the hydraulic power section 14 of the tool. In the preferred embodiment, the cylindrical collar section 42 has a lower part 76 and an upper part 78. Similar to the exterior of the collar section, the bore 74 also has a lower portion 74L, located in the lower part 76 of the collar, and an upper portion 74U located in the upper part 78. The lower portion 74L is threaded to engage the threaded upper end of the power section 14. The upper portion 74U of the bore is sized to form a close running fit with the ram 30 in the hydraulic power unit. The inner surface 84 is substantially smooth and forms a bearing surface for ram 30 as will be described in greater detail below. An annular groove 85 is formed into inner surface 84 for a wiper seal 86 or O-ring.

The movable adapter 18 is preferably a one-piece member which may be cast, forged, or fabricated in any other suitable manner. The movable adapter 18 has an upper or working end 90 which faces towards the anvil adapter 16 at the top of the workspace 48 when the movable adapter is mounted in the head section 12. The lower end 94 of the movable adapter may have a flat seating surface with may a projecting boss 92 to radially interlock adapter 18 to piston 30 and a fastener may be used to secure the adapter to the ram 30. As seen in FIGS. 1A–2, the body of the movable adapter 18 between the upper and lower ends 90, 94 has a flat face 98 positioned towards the inner surface 32 when the adapter is installed into the head section 12. The flat face 98 is seated substantially flush against the inner surface 32 of the longitudinal portion 45 of the head section 12. As can be realized from FIGS. 1A–2, the interface between the flat inner surface 32 and the flat face 98 of the movable adapter, maintains the movable adapter 18 generally aligned with the anvil 16 and prevents any rotation of the movable adapter 18 as it is advanced by the ram 30 towards the anvil 16.

Referring now again to FIG. 2, the hydraulic power section 14 which is mated to the collar section 42 of the head section 12 has a housing 15 which includes both the hydraulic cylinder 20 and the pump body 24. As noted before, the hydraulic power section 14 also has ram assembly 22, though the hydraulic power section may use any suitable ram. The ram assembly 22 is movably mounted to the housing 15. As shown in FIG. 2, ram assembly 22 generally comprises outer ram 30, spring 300, spring holder 302 and rapid advance ram actuator 28. The spring holder 302 may be an elongated, one-piece member having a generally cylindrical shape. The holder 302 may have an end 304, with a threaded portion or other means for fixedly mounting the holder into the housing 15. The holder 302 also has a main section 308 with an external radial flange 312 projecting outwards. The flange 312 has a spring support surface 316 facing the threaded end 304 of the holder and ram seating surface 314 located on the flange opposite the support surface 316 (see FIG. 2). As seen in FIG. 2, the spring holder 302 has a chamber 320 formed into the main section 308. The chamber 320 forms a hydraulic cylinder for the rapid advance actuator 28. The opening of the chamber 320 is located in the flanged end of the holder. The spring holder 302 also has a hydraulic fluid passage 326 which communicates with chamber 320 as seen in FIG. 2. The spring 300 in the ram assembly 22 may be a helically wound coil spring.

As shown in FIG. 2, the rapid advance ram actuator 28 generally includes an actuator body, spring loaded ball valve 330 and set screw. The body of the actuator 28 has a diameter sized to form a close sliding fit within chamber 320 in the spring holder 302. The length of the actuator body is sufficient to advance the outer ram 30 through the full range of ram travel allowed by hydraulic cylinder 20. The exterior of the body may have one or more O-ring grooves for O-rings 338 (only one is shown in FIG. 2) which form a hydraulic seal between the actuator 28 and chamber 320 in the spring holder 302. As seen in FIG. 2, in this embodiment the actuator body has a hydraulic fluid passage 332 extending through the body allowing fluid to pass through the actuator to the ram 30. The passage 332 includes an expanded chamber with an appropriate seat for the spring loaded check valve 330. The passage terminates in a threaded hole for the set screw used to set the pressure at which the valve 330 opens. The ram 30 has an upper shaft section 344, and an enlarged lower piston section 346. The piston section 346 is sized and is provided with one or more O-rings 357 (only one is shown in FIG. 2 for example purposes) to form a hydraulic seal between the piston 346 and cylinder 20. The upper shaft section 344 of ram 30 is sized to form a close sliding fit with the upper portion 74U of the bore in the collar section 42. The upper end of the shaft section 344 provides a mating surface for mounting movable adapter 18. The outer ram 30 has an inner chamber 356 formed therein. The opening of the inner chamber is at the rear end 354 of the ram 30. The length of the inner chamber 356 is sufficient to admit the main section 308 of the spring holder 302 therein when the ram 30 is fully retracted as shown in FIG. 2. As can be realized from FIG. 2, the surface of the chamber 356 is part of the hydraulic fluid contact surface 352 of the ram 30.

The ram assembly 22 may be assembled by inserting the rapid advance actuator 28 into the chamber 320 of the spring holder 302, then inserting the holder 302, and spring 300 into chamber 356 of ram 30 and mounting retention ring 301 into the chamber. The retention ring 301, which may be mounted into a groove in the chamber 356, holds the spring 300, spring holder 302 and actuator 28 inside the ram 30. The ram assembly 22 may them be installed into the housing 15.

Still referring now to FIGS. 1A–2, the housing 15 of the power section 14 is preferably a one-piece member which as noted before includes the hydraulic cylinder 20 and the pump body 24. In alternate embodiments the power section may have a housing assembly comprising a number of housing parts. As seen in FIG. 2, the hydraulic cylinder 20 is located in the upper portion of the housing 15. The annular flange 80 in the head section forms the upper end of the cylinder. The length of the cylinder is such that the ram 30 is provided with sufficient travel to advance the movable adapter 18 from the retracted position shown in FIG. 2 to a position (not shown) abutting the stops 64, 66 of the anvil 16. The housing 15 has a bore 262 opening into the bottom of the hydraulic cylinder 20 for mounting the spring holder 302, and hence the ram assembly 22 into the housing. The pump body 24 of housing 15 includes a hydraulic fluid conduit system 25 connecting the hydraulic cylinder 20 to the fluid reservoir 27. The pump 26 is located in the conduit system 25. The pump 26 is shown as being a one stage piston pump, although multi-stage pumps may be used equally well with the present invention. The conduit system 25 in pump body 14 shown in FIG. 2 is merely an example of a suitable conduit system, and the hydraulic tool may use any other suitable conduit system. The conduit system 25 may have a suction conduit 210 and a supply conduit 212. The conduit system 25 may also have a drain or return conduit 214. The suction conduit 210 may extend between the reservoir 27 and the hydraulic chamber 20. The suction conduit supplies hydraulic fluid to the hydraulic chamber to allow free movement to the ram 30 when advanced by the ram actuator 28. The suction conduit 210 may have a check valve (not shown) which is closed by fluid pressure in the hydraulic cylinder. The suction conduit 210 also supplies fluid to the supply conduit 212 which communicates with suction conduit 210. The supply conduit 212 may have a check valve (not shown) to prevent reverse flow from the supply conduit into the suction conduit when the supply conduit is pressurized by the pump 26. The supply conduit has pump chamber or bore 222 for pump 26. Downstream of pump chamber 222, and hence pump 26, the supply conduit 212 has a check valve 224 which prevents reverse flow in the conduit 212 when the pump 26 is in the suction stroke. Downstream of valve 224, the supply conduit 212 is routed to its discharge port in the bottom of bore 262. Thus, supply conduit 212 supplies hydraulic fluid to the chamber 320 to advance the actuator 28 in the spring holder 302, and when valve 330 is opened by ram 30 meeting resistance, the conduit supplies fluid into chamber 20. The supply conduit 212 also communicates with the drain conduit 214 to allow drainage of fluid from the supply conduit as well as the actuator chamber 120 in the spring holder 102. In addition, a portion of the drain conduit 214 extends between the bottom of the hydraulic chamber 20 and the reservoir 27 thereby allowing fluid to drain from the hydraulic cylinder. The conduit 214 may have check valves (not shown) which close when fluid is pumped in the supply conduit 212. The drain conduit 214 may also include a pressure sensing valve 228 which opens to drain the supply conduit 212 when an over pressure is sensed in the supply conduit or hydraulic chamber. The drain conduit 214 includes a plunger actuated valve 230 which when activated allows the supply conduit 212, actuator chamber 320 and hydraulic chamber 20 to drain through conduit 214 into the reservoir 27.

Figure 3:
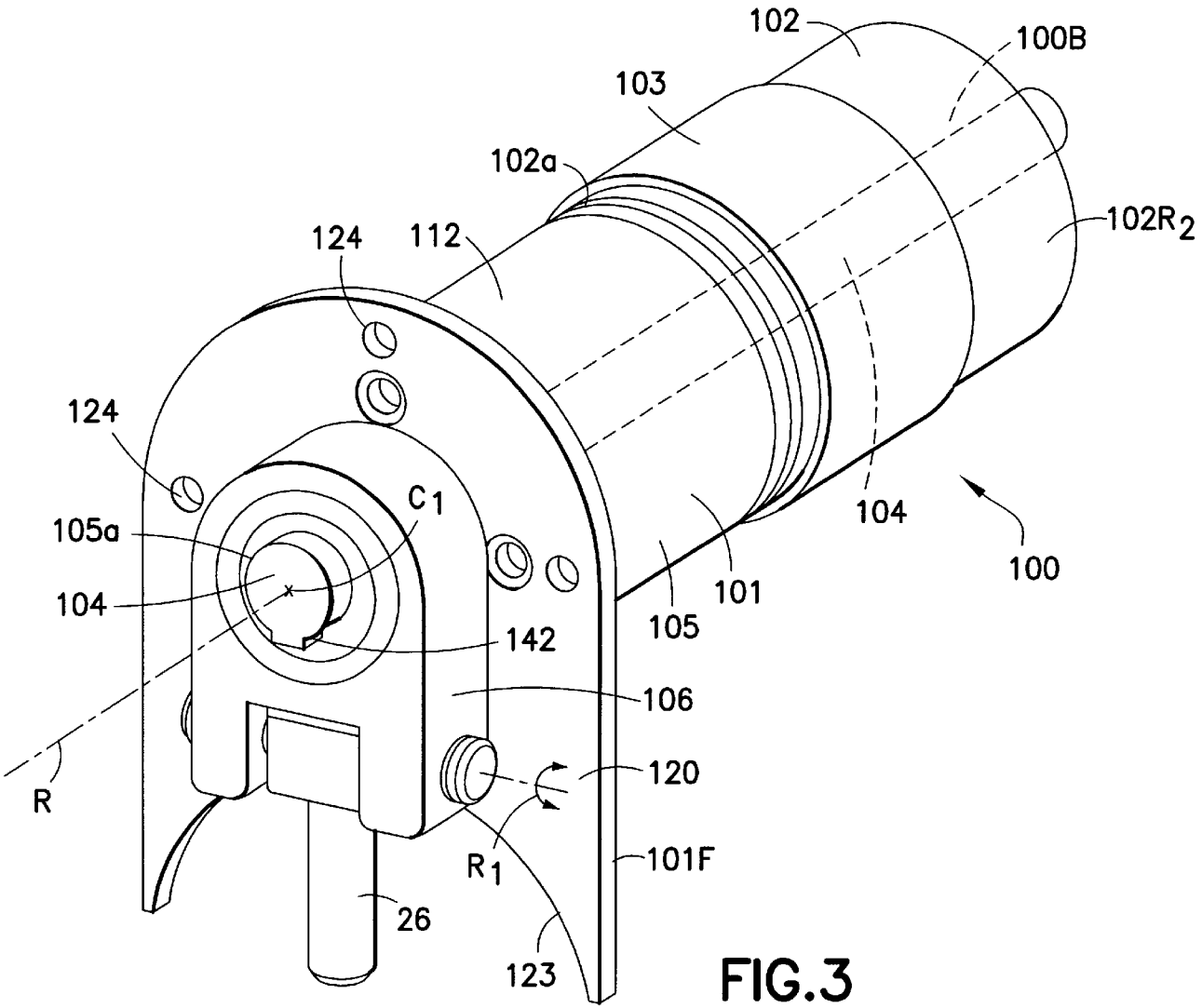
FIG. 3 is a perspective view of motor and handle portion of the hydraulic compression tool seen from a direction opposite to the direction of the view in FIG. 1.

As noted before, the pump 26 is powered by the motor 102 in the motor section 100. Referring now also to FIG. 3 which is a perspective view looking from front to rear, of the motor section 100 of the tool, the motor section 100 generally has a housing 101 enclosing the gear box 105, a motor 102 with a drive shaft 104, and a transmission linkage 106 (see FIG. 3). As seen in FIGS. 1A and 3, the housing has a rear section 101R and a front portion 101F. The rear housing portion 101R houses the motor 102, drive shaft 104 (See FIG. 3) for connection with a source of electricity via terminals 100B. The front housing portion 101F connects the motor section 100 to the housing 15 and houses the transmission linkage 106 between the drive shaft 104 and pump 26. The rear housing portion 101R is shown in FIGS. 1A and 3 as having a generally cylindrical shape, though in alternate embodiments the housing may have any suitable shape. The housings are configured to support the motor 102 therein and may include suitable brackets (not shown) for mounting the motor casing to the housing.

Figure 5:
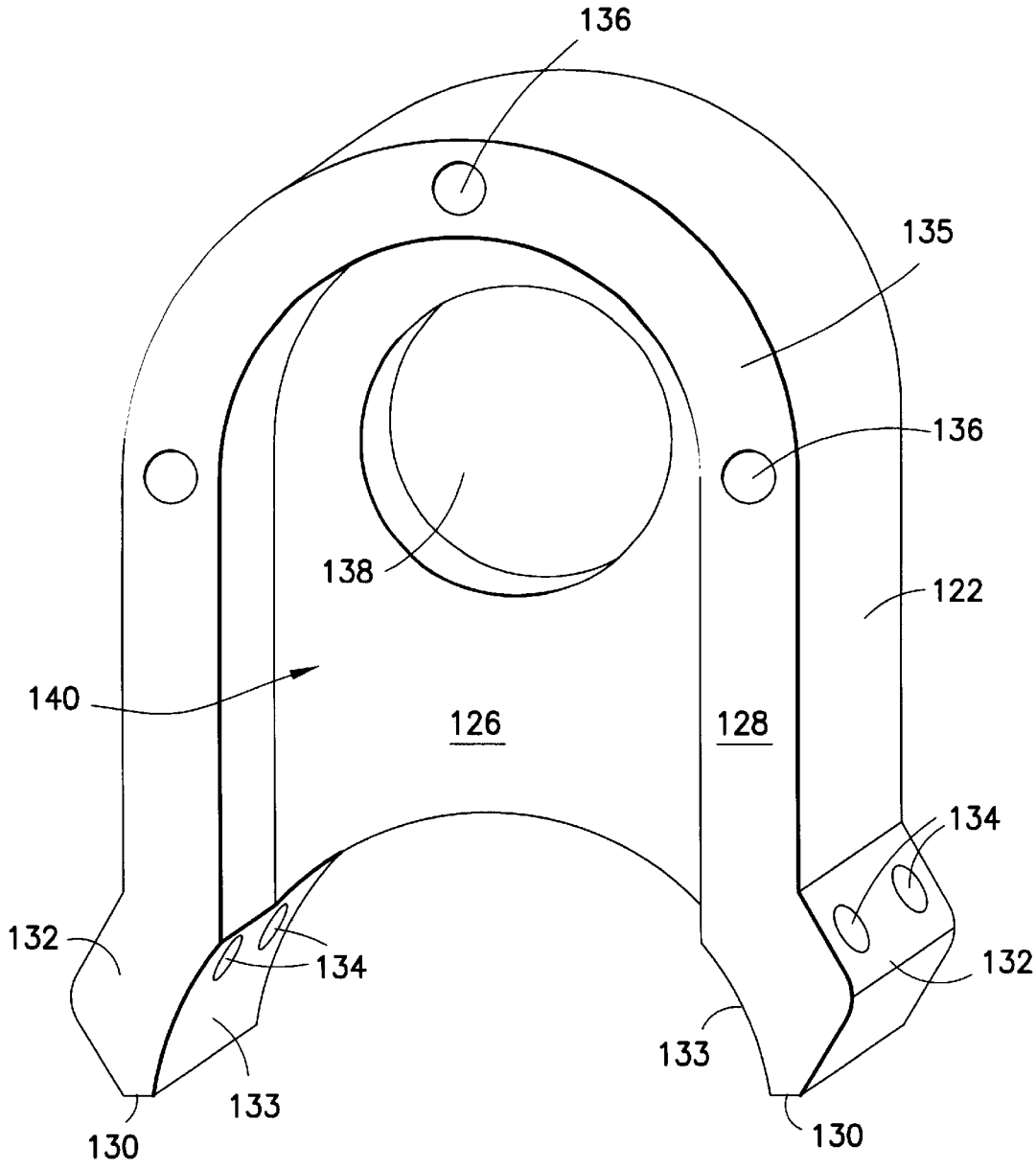
FIG. 5 is a perspective view of a portion of the housing for the power transmission of the hydraulic compression tool in FIG. 1.

As seen in FIG. 1A, the front portion 101F of the housing 101 preferably includes a support plate 120, and a cover 122. In alternate embodiments, the front portion of the housing may have any other suitable configuration. The support plate 120 is at the rear and the cover 122 is at the front. The cover 122 may be removably mounted to both the support plate 120 and housing 15 as will be described in greater detail below. As seen best in FIG. 3, the support plate 120 may be is a substantially flat plate member which may be stamped from sheet metal or cut from plastic sheets. The support plate 120 may include a cutout 123 complementing the exterior of the pump body 24. The support plate 120 may also have a number of fastener holes 124 for fasteners used to mount the cover 122 to the plate 120. As can be realized, a bore (not shown) is formed into the plate 120 to allow output shaft 104 to extend through the plate. The support plate 120 may be attached to the front end 118 of the gear box 105 by any suitable means such as welding, brazing, or bonding using adhesives or fasteners. The front cover 122 is seen best in FIG. 5. The cover may be a one-piece member made of metal which is cast or drop-forged, or otherwise may be made of plastic by injection molding for example. Further, the support plate 120 and cover 122 could be fabricated as a single piece instead of two separate components. The cover 122 has an end wall 126 surrounded on three sides by peripheral wall 128. The peripheral wall 128 has a general U-shape. As seen in FIG. 5, at the ends 130 the wall 128 flares outward defining attachment pads 132 for attaching the cover 122 to the pump body 24. The attachment pads 132 have curved seating surfaces 133 conforming to the curvature of the exterior of the pump body 24. Fastener holes 134 are formed through the pads for mechanical fasteners (not shown) such as for example machine screws used to attach the cover 122 to the pump body. The peripheral wall 128 has a rear seating surface 135 for seating against the support plate 120. The seating surface may be substantially flat or may be provided with a groove for a seal gasket (not shown) to be placed between the cover and support plate at mounting. Longitudinal fastener holes 136 are included in the peripheral wall 128 corresponding to fastener holes 124 in the support plate 120. End wall 126 has a bore 138 used to mount an end bearing (not shown) supporting the front end 105 of the output shaft 104 (see FIG. 3). A bearing (not shown) may be installed into bore 138 to close the front of the bore. The end wall 126 and peripheral wall 128 form a chamber 140 sufficiently deep to accommodate the transmission linkage 106 inside the chamber. Bore 138 is located in end wall 126 so that when the cover 122 is mounted to support plate 120, the bore 138 is aligned with the output shaft 104.

The motor 102 is preferably a single speed DC motor, although any suitable electro-mechanical motor may be used including an AC motor. An example of a suitable motor is an 18V DC Mabuchi motor, model RS-775 WC.8514. An advantage of the DC motor is that it may be readily powered using conventional batteries. A suitable reduction gear box 105 is mated to the drive shaft of the motor 102. For example, in the event the rotary speed of the motor drive shaft is higher than the desired rotary speed of the output shaft 104 at the transmission 106, the reduction gear box couples the motor shaft to the output shaft 104 such that the output shaft 104 would be coupled to an output end of the reduction gear. The reduction gear box may be of any suitable type such as for example, a planetary reduction gear rated for the rotary speed and torque of the motor. The reduction ratio across the reduction gear may be any suitable ratio to provide the output shaft 104 with a desired rotary speed. As noted before, the output shaft 104 may extend from the motor 102, or in the case a reduction gear is used, from the output end of the gear to the transmission linkage 106. The output shaft 104 may be solid or hollow, and may be made from metal such as for example steel or aluminum alloy, or from non-metallic materials such as plastic having adequate stiffness and strength to withstand the forces and torques which the shaft is subjected. As seen in FIG. 3, the output shaft 104 has a key 142 or other suitable interlocking features such as for example radial splines, or teeth with which to engage and transfer torque to a mating component. The output shaft 104 is supported by suitable bushings or bearings (not shown) to support torque and pump loads on the shaft. The output shaft 104 protrudes from plate 120 sufficiently for the front end 105 of the shaft to be rotatably supported in the bore 138 of the end wall 126 (See FIG. 5). The portion of the output shaft 104 extending in chamber 142 formed between the support plate 120 and end wall 126 in the front housing section 101F provides a mounting surface for the transmission linkage 106.

Figure 4:
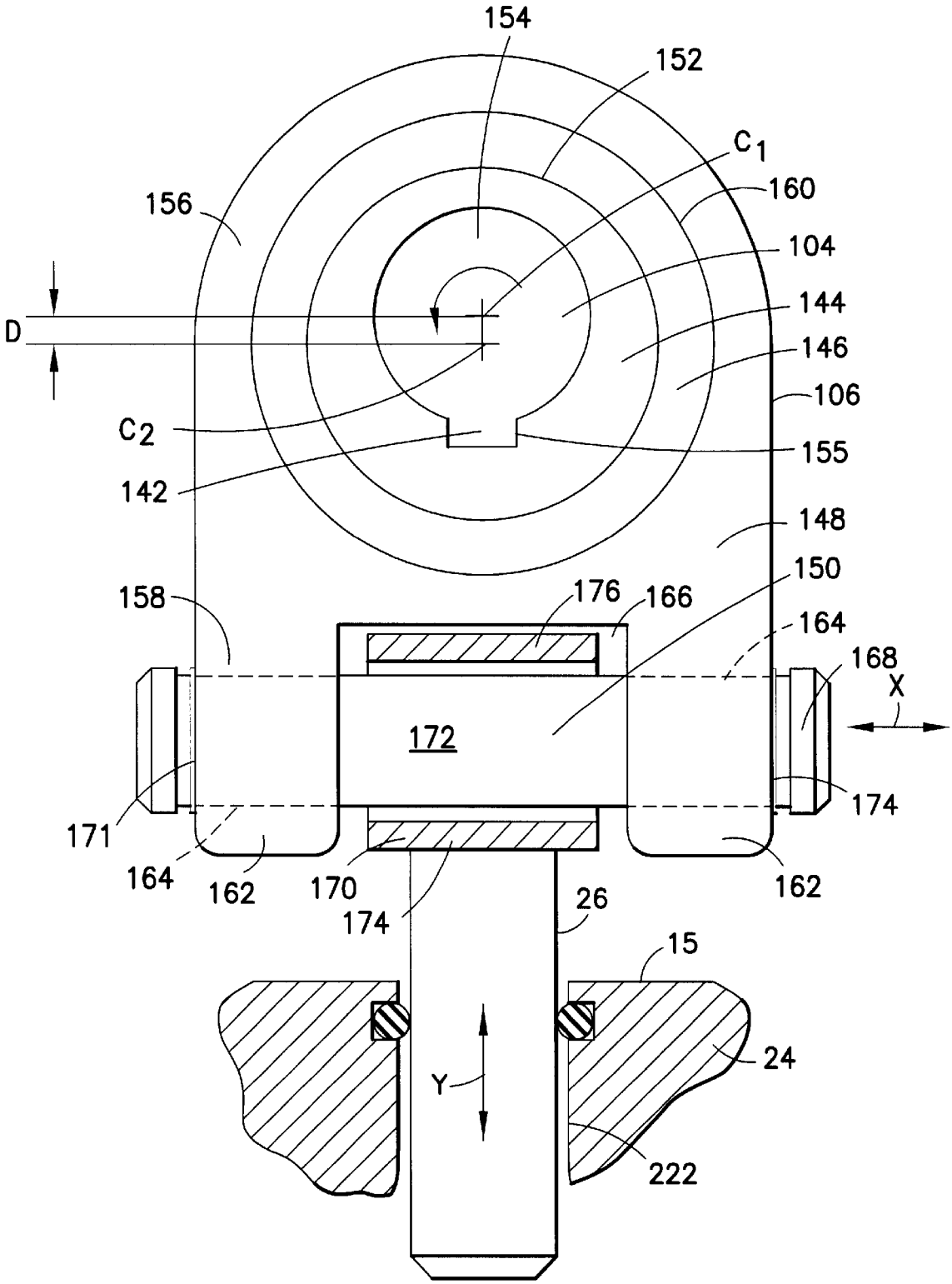
FIG. 4 is a partial cross-sectional elevation view of the pump body and a power transmission of the hydraulic compression tool in FIG. 1.

Referring now to FIGS. 3 and 4, the transmission linkage 106 generally includes eccentric 144, bearing 146, collar link 148 and slider mechanism 150. The eccentric 144 and bearing 146 are used to rotatably mount the collar link 148 on the output shaft 104, and the slider mechanism 150 is used to connect the collar link 148 to the pump 26 as will be described in greater detail below. The eccentric 144 is preferably a one-piece member which may be forged or machined from metal such as for example aluminum alloy. In alternate embodiments with low force environments, the eccentric may be made from non-metallic material such as plastic, ceramic or composite material having sufficient compression strength to withstand compression loads between the output shaft and collar link. As will be described further below, the mounting configuration of the eccentric 144 on the shaft 104 and in the collar link results in the compression loads between the collar link and shaft, during operation of the tool 10, being distributed over a wide area. The eccentric 144 has a substantially circular outer surface 152. The center of the outer surface 152 is located at location C2 in the position shown in FIG. 4. The eccentric 144 has a substantially circular inner bore 154 with the center located at location C1 in the position shown in FIG. 4. As can be realized from FIG. 4, the circular inner bore 154 is eccentric relative to the circular outer surface 152 with the corresponding centers (at locations C1 and C2 respectively) separated by a distance D. The distance D is about a half of the total stroke of the pump 26 in the pump body 24. The inner bore 154 in the eccentric is shaped and sized to form a close or light press fit with the output shaft 104. Accordingly, the inner bore 14 has a keyway 155 which closely conforms to the key 142 of the shaft 104. The location of the keyway 155 in the eccentric 144 is shown in FIG. 4 as being substantially in line with the offset D between the center of the inner bore 154 and the center of the outer surface 152 only for example purposes, and in alternate embodiments, the keyway 155 may be positioned anywhere along the surface of the inner bore. The close fit between the inner bore 154 of the eccentric 144 and the output shaft 104 prevents impact or slap between eccentric and shaft operation, thereby preventing impact loads on the shaft and during eccentric, reducing operating noise and increasing pump efficiency.

In the preferred embodiment, the bearing 146 in the transmission linkage 106 is a radial caged needle bearing such as a Torrington® B 1210 bearing. The bearing 146 may be a sealed self lubricating bearing or an open bearing. In alternate embodiments, the bearing 146 may be any other suitable bearing or bushing rated to rotate at a rotational speed of up to about 1300 RPM or more for an indefinite time. The inner race (not shown) of the bearing is sized to form a light force fit with the outer surface 152 of eccentric 144.

The collar link 148 is preferably a one-piece member although in alternate embodiments, the link may be an assembly of parts. The collar link may be made from metal, such as aluminum alloy by casting, forging or even pressing and sintering, or otherwise may be formed from plastic. In alternate embodiments with low force environments, non-metallic material such as plastic, or ceramic may be used. The collar link may have a main section 156 and a collar section 158 as seen in FIG. 4. The main section 156 has a substantially circular bore 160 formed therein. The bore 160 has a center which is located at location C2 when the collar link 148 is positioned as shown in FIG. 4. The bore 160 is sized to form a light press fit with the outer race (not shown) of bearing 146. As seen in FIG. 4, in the preferred embodiment, two arms 162 depend from the main section 156 at opposite edges of the clevis link and form the clevis section 158. Also as seen in FIG. 4, each arm 162 has a bore 164 formed therethrough. The bores,164 in each arm are aligned with each other and substantially orthogonal to the bore 160 in the main section 156. The arms 162 define a recess 166 in between. In the preferred embodiment, the recess 166 is centrally located below 160, though in alternate embodiments the recess may be offset from the bore.

Still referring to FIGS. 3 and 4 in the preferred embodiment, the slider mechanism 150 comprises a pin 168 and a sleeve bearing or bushing 170 capable of sliding freely upon the pin 168. The pin 168 may be an elongated cylindrical member made from metal or plastic. The pin 168 is sized to be inserted through the bores 164 in the arms 162 of the collar link 148 as shown in FIG. 4. At least a portion 172 of the pin has an outer surface with a surface roughness suitable for sliding bushing 170 back and forth over the pin without damage to the bushing. The outer ends of the pin 168 may form a press fit with the bores 164 in the clevis arms 162. In addition the outer ends of the pin may have annular grooves (not shown) formed into the outer surface for snap rings 174 used to axially lock the pin into the collar link 148.

As noted before, the slide mechanism 150 also includes slide bushing 170. The slide bushing 170 is preferably a one-piece member. The bushing may be made from oil-impregnated bronze material, or from a lubricious plastic or composite material incorporating Teflon™ or from any other surface material. The bushing 170 has a cylindrical bore 176 sized to form a close sliding fit with the sliding portion 172 of the pin. This fit allows for the bushing 170 to slide freely along the pin 168 in the direction indicated by arrow X in FIG. 4, as well as rotate freely about the pin in the direction indicated by arrow R1 in FIG. 3. The close sliding fit between bushing 170 and pin 168 also ensures that there is no impact or slap between bushing and pin in a direction orthogonal to that indicated by arrow X in FIG. 4. The exterior of the bushing 170 may have any suitable shape which allows the bushing to be located in recess 166 of the clevis section 158. The bushing 170 may have an attachment section 174 for fixedly attaching the bushing to the pump 26. For example, the attachment section 174 may include a post (not shown) which can be inserted into a mating bore in the pump, or conversely a collar (not shown) which may be placed around the pump to fixedly secure the bushings 170 to the pump 26. The pin 168 and bushing 170 provide a pivotable joint 171 between the collar link 148 and pump 26.

The transmission link 106 may be assembled and mounted to the output shaft 104 in a number of equally suitable ways, one of which is described below for example purposes. The eccentric 144 may be press fit into the inner race of bearing 146. The bearing 146 may then be press fit into the bore 160 of the collar link 148. The pin 168 may be inserted at any suitable time through the bores 164 of the clevis arms 162 securing the bushing in the collar link. The bushing 170 may be attached to the pump 26 before placement into the collar link 148 or after the bushing is secured to the link. After the pin 168 is inserted into the collar link 148, snap rings 174 may be placed around the pin locking the pin axially in the link. The slip fit between the pin 168 and bores 164 allows the pin to spin in the bores though in alternate embodiments the pin may not be free to spin in the bores. In alternate embodiments, the pin may be staked or pinned to the clevis arms thereby fixing the pin in the link in all directions. The transmission linkage assembly 106 may then be mounted onto the output shaft 104.

The transmission linkage 106 is mounted onto shaft 104 by sliding the eccentric 144, which may be already positioned in the collar link as noted before, over the end 105*a* of the shaft 104. The keyway 155 on the eccentric is aligned with the key 142 on the shaft 104, and the shaft enters into bore 154 of the eccentric. As can be seen in FIGS. 3 and 4, the shaft centerline and axis of rotation of the shaft R is located at location C1, the center of the eccentric bore 154. Hence, the shaft 104 is eccentric to the bore 160 in the collar link 148, the shaft centerline at C1 is being offset distance D from the center of bore 160 at C2. However, the shaft 104 contacts the surface of bore 154 in the eccentric around the circumference of the eccentric, and the outer surface of the bearing 146 contacts the surface of bore 160 in the collar link 148 around the circumference of the bearing. This allows the shaft 104 with the eccentric 144 thereon to rotate freely relative to the collar link 148. Though the eccentric 144 is free to spin relative to the collar link 148, the eccentricity between the axis of rotation R of the shaft 104 at C1 and the center of the bore 160 at C2 causes the eccentric to rotate about axis R relative to the collar link while moving the collar link 148 in an orbital motion about axis R. The orbit motion of the collar link 148 about axis R has an orbit radius equal to distance D (see FIG. 4).

After mounting the transmission linkage 106 in the shaft 104, the end bearing (not shown) may be placed on end 105*a* of the shaft and the gear box 105 mounted to support plate 123. The motor section 100 may then be mounted to the housing 15 as shown in FIG. 1A. In the preferred embodiment, the pump 26 has already been secured to the slide bushing 170. Accordingly, when the motor section 100 is placed against the housing 15, the pump 26 is inserted into pump chamber 222 of the pump body 24. The motor section 100 is then secured by inserting fasteners through the fastener holes 134 of the cover 122 (see FIG. 5) into the housing 15.

After the motor section 100 is mounted to housing 15, the tool 10 may be operated by energizing the motor 102. The motor 102 is preferably provided with a control, such as an on/off switch with which the operator controls the motor. When energized, the motor rotates the output shaft 104 about axis R. As noted before, the rotation of the shaft 104, with eccentric 144 thereon, causes the collar link 148 to move in an orbital motion about axis R. The orbital motion of the collar link 148 has components along orthogonal directions indicated by arrows X and Y in FIG. 4. Collar motion in the direction indicated by arrow Y brings the pin 168 in the collar link 148 against the slide bushing 170 thereby actuating the pump 26 in the Y direction in and out of the chamber 222 in the pump body. Collar motion in the X direction slides the pin 168 inside the slide bushing 170. Thus, the transmission linkage 106 transforms the rotational motion of the shaft 104 into reciprocating rectilinear motion of the pump 26 inside the pump body 24. One revolution of the shaft 104 actuates the pumping through one in/out cycle in chamber 222. Actuation of the pump 26 in the pump body 24 draws hydraulic fluid from the suction conduit 210 (see FIG. 2) and supplies it under pressure through the supply conduit 212 to the ram assembly 22 to move the movable adapter 18 of the tool 10.

As can be realized from FIGS. 3 and 4, the freedom of movement of the pivotable joint between the collar link 148 and pump 26 accommodates misalignment between the motor section, particularly the location and angle of axis of rotation R relative to the location or shaft 104 of the pump bore 222 in the pump body. For example, if the motor section 100 when mounted to housing 15 and the shaft 104 is positioned such that axis R is inclined rather than orthogonal to bore 222, or the collar link is not positioned directly over the bore 222, the pivotable joint 171 between collar link 148 and pump 26 allows the pump 26 to nevertheless be installed true in the pump bore 222, and the transmission linkage 106 to operate without binding or excessive wear of either the slider mechanism 150 or the bearing 146. The pivotable joint 171 between pump 26 and link 148 allows the bearing 146 to remain true on the shaft 104 and in the collar link so that the bearing may rotate freely. The cylindrical surfaces of the pin 168 and slide bushing 170, which effect the pivoting freedom of joint 171, also allow the slide bushing 170 to slide freely along the pin (in the direction indicated by arrow X) regardless of whether the collar link 148 is angled relative to the pump 26.

The full circumferential contact between the eccentric 144 and bearing 146 and the bearing 146 and collar link 148 provides large bearing surfaces which in turn reduces contact stress on these components with a commensurate reduction in wear and an increase in the life of the component. Similarly the large bearing surfaces between the pin 168 and slide bushing reduces contact stress between these components. For example, for a slide bushing 170 having a length of 0.5 inch and a pin with a diameter of 0.31 inch, the contact stress from a 750 lbs. load on the pump 26 is about 3100 psi. Stresses of this order of magnitude are low relative to the yield stress of many metal alloys including light and inexpensive aluminum allows without heat treatment. Contact stresses of the magnitude noted above may also be readily supported by non-metallic materials such as plastic without creep or deformation of the material. Aluminum alloys or plastic are inexpensive and easy to shape or machine. Aluminum alloys or plastic are also light. Thus, use of aluminum alloys or plastic in manufacturing components such as the transmission linkage 106 of the tool 10, reduces the weight of the tool 10, as well as manufacturing cost in comparison to conventional hydraulic power tools. The transmission linkage 106 continuously transfers power from the shaft 104 to the pump 26 actuating the pump both into and out of the pump chamber 222. This facilitates very high pump speeds without limitations due to spring response as in conventional hydraulic tools. The high pump speeds achievable with tool 10 allow crimping operations to be completed faster than using conventional hydraulic crimping tools.

In sharp contrast to drive 100 and tool 10, conventional hydraulic tools that use springs as the primary device to return the piston pump to its home position have several disadvantages. Springs have a finite life, require additional room to package, and can produce "valve hop". Valve hop is a condition when the spring response does not coincide with the speed of the device. In hydraulic tools, the spring may cause "piston hop", where the piston pump may not stay fully engaged with the drive shaft. Such a condition would produce less pump stroke and therefore a relatively longer crimp cycle time. In addition, the spring preload against the piston drives up the power demand during pump operation (i.e. the motor is working against hydraulic pressure and spring preload on the piston) thereby consuming more power. This is significant in battery powered tools. In the case of conventional hydraulic tools employing a cam link mechanism as disclosed in U.S. Pat. Nos. 5,111,681 and 5,195,354, the manufacture of such a mechanism may involve either welding of two components or considerable machining time. In addition, the parts of the cam mechanism would most likely need heat treatment. Also alignment of the annular portion of the mechanism to the shaft may be very difficult. It is preferred to have the needle bearing outer race in full contact with the contoured inner portion. However, in the conventional tools, the bearing is not in full contact and bearing life may be reduced. Also since the needle bearing outer race is allowed to translate within the contoured cavity, ample clearance may exist between the outer bearing race and contoured surface, primarily, clearance in the direction of piston pump movement. The subject clearance may be relatively small in this direction, however, such clearance is not desired because it may produce a "rapping" sound and create excessive wear. Wear can result because there is a substantial load being applied to a relatively small contact point. The contact point in this case is the apex of the needle bearing outer race. The present invention overcomes the above noted problems or conventional hydraulic tools as previously described.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A transmission for connecting a rotary motor output shaft to a rectilinear actuator which is movable rectilinearly along an actuator axis of translation, the transmission comprising:

a frame with a bore formed therein;

an eccentric adapted to position the frame on the rotary motor output shaft, the eccentric being rotatably mounted in the bore of the frame to rotate relative to the frame; and a rectilinear guide connected to the frame, the rectilinear guide having a slide surface adapted to be slidably seated against the rectilinear actuator allowing the frame to slide substantially rectilinearly relative to the rectilinear actuator, wherein the frame has a recess formed therein, the recess being sized and shaped for movably locating at least part of the rectilinear actuator in the recess, the rectilinear guide extending across the recess.

2. The transmission according to claim 1, wherein the frame slides relative to the rectilinear actuator along an axis of translation substantially orthogonal to the actuator axis of translation.

3. A transmission for connecting a rotary motor output shaft to a rectilinear actuator which is movable rectilinearly along an actuator axis of translation, the transmission comprising:

a frame with a bore formed therein;

an eccentric adapted to position the frame on the rotary motor output shaft, the eccentric being rotatably mounted in the bore of the frame to rotate relative to the frame; and a rectilinear guide connected to the frame, the rectilinear guide having a slide surface adapted to be slidably seated against the rectilinear actuator allowing the frame to slide substantially rectilinearly relative to the rectilinear actuator, wherein the rectilinear guide comprises a pin, an outer surface of the pin forming the slide surface.

4. The transmission according to claim 3, wherein the rectilinear guide extends through an aperture in the rectilinear actuator.

5. A hydraulic tool drive comprising:

a frame with a hydraulic reservoir;

a hydraulic ram movably mounted to the frame;

a pump connected to the frame, the pump having a pump piston for pumping hydraulic fluid to move the hydraulic ram relative to the frame;

a motor connected to the frame, the motor having an output shaft that rotates about an axis of rotation when the motor is operating; and a link operably connecting the output shaft to the pump piston for generating reciprocating movement of the pump piston when the motor is operating, wherein the link is rotatably mounted on the output shaft and is pivotable at least at one end relative to the frame, wherein the link has an end which is movably mounted to the pump piston so that the link moves freely relative to the pump piston.

6. The drive according to claim 5, wherein the link has a bore formed therein for mounting the link onto the output shaft, the output shaft being eccentrically positioned in the bore when the link is mounted to the output shaft.

7. The drive according to claim 5, further comprising an eccentric fixedly mounted to the output shaft, the eccentric having an inner bore which is concentric with the output shaft and having an outer surface which is concentric with a bore in the link in which the eccentric is seated.

8. The drive according to claim 5, further comprising a bearing concentrically mounted into a bore in the link, the bearing being located between a portion of the output shaft in the bore and the perimeter wall of the bore.

9. A hydraulic tool drive comprising:

a frame with a hydraulic reservoir;

a hydraulic ram movably mounted to the frame;

a pump connected to the frame, the pump having a pump piston for pumping hydraulic fluid to move the hydraulic ram relative to the frame;

a motor connected to the frame, the motor having an output shaft that rotates about an axis of rotation when the motor is operating; and a link operably connecting the output shaft to the pump piston for generating reciprocating movement of the pump piston when the motor is operating, wherein the link is rotatably mounted on the output shaft and is pivotable at least at one end relative to the frame, wherein the at least one end of the link is pivotally connected to the pump piston by a pin.

10. A hydraulic tool drive comprising:

a frame with a hydraulic reservoir;

a hydraulic ram movably mounted to the frame;

a pump connected to the frame, the pump having a pump piston for pumping hydraulic fluid to move the hydraulic ram relative to the frame;

a motor connected to the frame, the motor having an output shaft that rotates about an axis of rotation when the motor is operating; and a link operably connecting the output shaft to the pump piston for generating reciprocating movement of the pump piston when the motor is operating, wherein the link is rotatably mounted on the output shaft and is pivotable at least at one end relative to the frame, wherein the link has a recess in one end, at least one end of the pump piston being located in the recess.

11. The drive according to claim 10, wherein the link has a pin which extends across the recess.

12. The drive according to claim 10, wherein the pump piston has a slide bushing located at the at least one end of the pump piston.

13. The drive according to claim 12, wherein the pin extends through the slide bushing, the slide bushing being seated against the pin when the link moves the pump piston, the pin sliding rectilinearly on the slide bushing.

14. The tool according to claim 13, wherein when the link moves the pump piston, the link slides on the slide bushing in a direction substantially orthogonal to a reciprocating movement direction of the pump piston.

15. The drive according to claim 13, wherein the slide bushing is made of at least in part from an oil impregnated bronze material or a lubricious non-metallic material.

16. A hydraulic tool drive comprising:

a frame with a hydraulic reservoir;

a hydraulic ram movably mounted to the frame;

a pump connected to the frame, the pump having a pump piston for pumping hydraulic fluid to move the hydraulic ram relative to the frame, the pump piston being movable relative to the pump along an axis of rotation;

a motor connected to the frame, the motor having rotary output shaft; and a collar connected to the rotary output shaft and having a joint at which the collar is movably joined to the pump piston to move relative to the pump piston along another axis of translation which is substantially orthogonal to the axis of translation of the pump piston, wherein the collar comprises a frame with a generally cylindrical bore in which the rotary output shaft is eccentrically located, the frame having a clevis at one end which forms the joint in the collar.

17. The drive according to claim 16, wherein the joint between the collar and the pump piston is adapted to allow the collar to move in two independent degrees of freedom relative to the pump piston.

18. The drive according to claim 17, wherein one of the two independent degrees of freedom is provided by the collar being able to move along the other axis of translation, and another of the two degrees of freedom is provided by the collar being able to pivot about the other axis of translation.

19. The drive according to claim 16, wherein the collar comprises a pin mounted in the frame to extend through the clevis.

20. The drive according to claim 16, wherein the pump piston includes a linear slide bearing, the linear slide bearing being seated against a slide surface of the collar located at the joint of the collar to the pump piston.

21. A hydraulic tool drive comprising:

a frame with a hydraulic reservoir;

a hydraulic ram movably mounted to the frame;

a pump connected to the frame, the pump having a pump piston for pumping hydraulic fluid to move the hydraulic ram relative to the frame, the pump piston being movable relative to the pump along an axis of rotation;

a motor connected to the frame, the motor having a rotary output shaft; and a collar connected to the rotary output shaft and having a joint at which the collar is movably joined to the pump piston to move relative to the pump piston along another axis of translation which is substantially orthogonal to the axis of translation of the pump piston, wherein the drive further comprises an eccentric fixedly mounted to the rotary output shaft, the eccentric being engaged to the collar so that when the motor rotates the rotary output shaft the collar is moved in an orbital motion relative to the output shaft.

22. A hydraulic crimping tool comprising:

a frame with a hydraulic reservoir;

a hydraulic ram movably mounted to the frame;

a pump connected to the frame, the pump having a pump piston for hydraulically moving the hydraulic ram relative to the frame;

a motor connected to the frame, the motor having a rotary output shaft; and a transmission connecting the rotary output shaft to the pump piston, the transmission comprising an eccentric fixedly mounted onto the rotary output shaft and a collar rotatably mounted onto the eccentric to rotate relative to the eccentric, the collar being movably joined to the pump piston, wherein the collar has a clevis, the pump piston being pinned to the collar in the clevis.

23. The tool according to claim 22, wherein the collar is movably joined to the pump piston to allow the collar to move in two independent degrees of freedom relative to the piston.

24. The tool according to claim 22, wherein the collar is movably joined to the pump piston so that the collar is free to slide rectilinearly relative to the pump piston, and is free to pivot relative to the pump piston.

25. The tool according to claim 22, wherein the collar has a bore, the eccentric being concentrically disposed in the bore and holding the collar eccentric relative to the rotary output shaft.

26. The tool according to claim 22, wherein the pump piston has a linear slide bushing located in the clevis of the collar, the collar having a slide surface in the clevis which slides along the linear slide bushing when the motor rotates the rotary output shaft.

27. The tool according to claim 22, further comprising a housing connected to the frame for housing the transmission connecting the rotary output shaft to the pump piston.

* * * * *